US006595345B2

(12) United States Patent
Sjögren

(10) Patent No.: US 6,595,345 B2
(45) Date of Patent: Jul. 22, 2003

(54) METHOD AND A DEVICE FOR THE TEMPORARY STORAGE OF PRINTED MATTER

(75) Inventor: Rolf Sjögren, Eksjö (SE)

(73) Assignee: Idab Wamac International AB, Eksjo (SE)

( * ) Notice: Subject to any disclaimer, the term of this patent is extended or adjusted under 35 U.S.C. 154(b) by 0 days.

(21) Appl. No.: 09/554,084

(22) PCT Filed: Oct. 9, 1998

(86) PCT No.: PCT/SE98/01820

§ 371 (c)(1),
(2), (4) Date: May 12, 2000

(87) PCT Pub. No.: WO99/32386

PCT Pub. Date: Jul. 1, 1999

(65) Prior Publication Data

US 2002/0175045 A1 Nov. 28, 2002

(30) Foreign Application Priority Data

Dec. 11, 1997 (SE) ..... 9704623

(51) Int. Cl.[7] ..... B65G 37/00; B65H 29/66; B65H 39/06; B65H 33/00

(52) U.S. Cl. ..... 198/347.3

(58) Field of Search ..... 198/347.3, 429, 198/430, 418.9

(56) References Cited

U.S. PATENT DOCUMENTS

| | | | | | |
|---|---|---|---|---|---|
| 4,509,703 | A | * | 4/1985 | Grunder | 198/347.3 |
| 4,569,488 | A | * | 2/1986 | Baltisberger | 198/347.3 |
| 5,018,618 | A | * | 5/1991 | Sjogren | 198/347.3 |
| 5,070,999 | A | * | 12/1991 | Layne et al. | 198/724 |
| 5,121,825 | A | * | 6/1992 | Sjogren | 198/347.3 |

FOREIGN PATENT DOCUMENTS

| | | |
|---|---|---|
| NO | 300 170 | 4/1997 |
| SE | 417 491 | 3/1981 |
| SE | 460 186 | 9/1989 |
| SE | 468 354 | 12/1992 |

* cited by examiner

*Primary Examiner*—D. Glenn Dayoan
*Assistant Examiner*—Patricia L. Engle
(74) *Attorney, Agent, or Firm*—Jacobson Holman PLLC

(57) ABSTRACT

A stream of newspapers (2) is stored temporarily by dividing the stream (2) into longitudinal sections. A carrier (5, 6) is releasably connected to one long edge of each generally flat section (3), to form product units (7) which are hung side-by-side in a transport cassette (30), by resting the end-parts of the carrier on respective bearing surfaces in the cassette (30). The cassette is carried by lowerable legs which enable the newspaper sections to hang freely down from the cassette. The cassette includes transport handling means (32). A newspaper stream (2) is formed from the temporarily stored units (7), by removing the carriers (5, 6) from said sections (3) and joining said sections end-to-end.

16 Claims, 2 Drawing Sheets

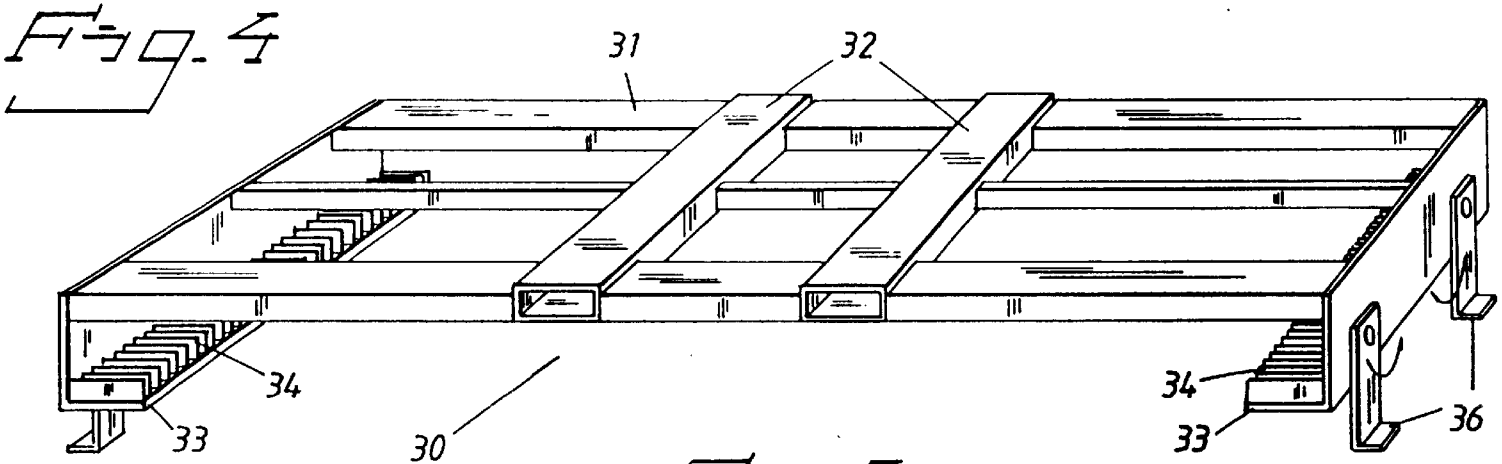
Fig. 4
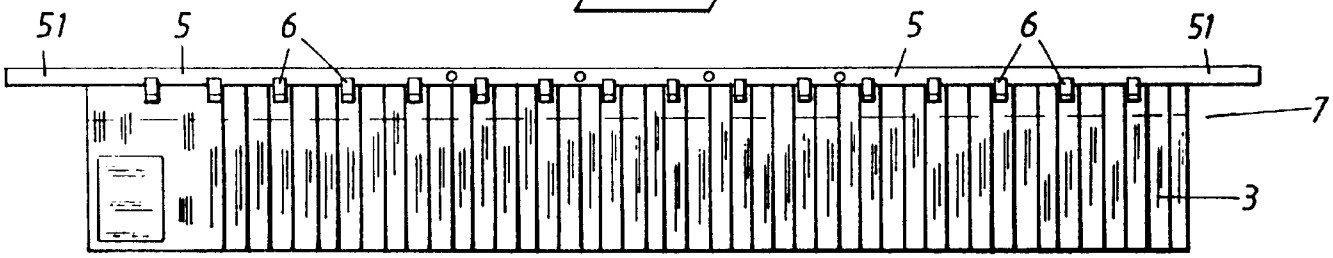
Fig. 5
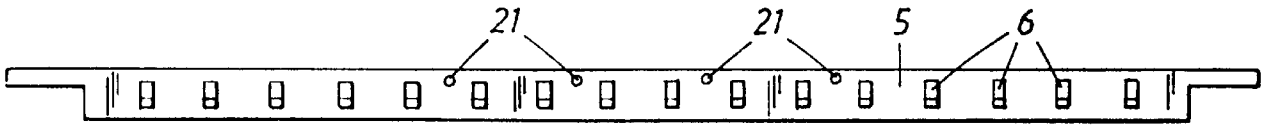
Fig. 6
Fig. 7

METHOD AND A DEVICE FOR THE TEMPORARY STORAGE OF PRINTED MATTER

BACKGROUND OF THE INVENTION

FIELD OF THE INVENTION

The present invention relates to a method for the temporary storage of printed matter in which the stream is divided into generally straight, longitudinal sections, in which the sections are placed side-by-side in a storage space, and in which a stream of printed matter is re-created by joining sections together end-to-end.

The present invention also relates to apparatus for the temporary storage of printed matter.

The invention involves the features in which a stream of printed matter (newspapers) arriving, e.g., from a printing press in, e.g., an overlap configuration, are divided into, e.g., straight longitudinal sections, and in which the sections are disposed side-by-side in a storage space and a stream of printed matter is later re-created by joining together the ends of said sections. By printed matter is meant so-called wide-spread objects, such as newspapers, journals, magazines and the like. The invention is discussed hereinafter with reference to newspapers, although it will be understood that the inventive technique can be applied generally with wide-spread or surface-spread objects, normally rectangular objects, such as printed matter.

These features can be read from SE-B-468-354 which is also U.S. Pat. No. 5,018,618 to Sjogren, which discloses the so-called intermediate storage of a stream of newspapers in some kind of paternoster mechanism.

One advantage with the technique taught by SE-B-468-354 or U.S. Pat. No. 5,018,618 to Sjogren is that the relative distance or spacing of the newspapers in each section and their relative positions of rotation are not greatly influenced in the sections, since said sections are handled and stored in a flat, horizontal state. The stream of printed matter, newspapers, can be easily re-created, by joining together the ends of respective sections with the aid of an overlap. This re-created stream of printed matter can be moved directly in the same direction as that in which it arrived at the temporary storage rotation.

However, a serious drawback with the technique taught by SE-B-468-354 or U.S. Pat. No. 5,018,618 to Sjogren is that the temporary storage capacity is low in relation to the complexity of the apparatus and in relation to cost. Furthermore, it is necessary to store the sections in the apparatus, which is stationary in principle. The known technique is therefore less favourable when large volumes of newspapers shall be stored temporarily. Furthermore, the known technique lacks the possibility of transporting the temporarily stored newspapers after said newspapers have been taken into the temporary storage facility.

Consequently, when requiring to temporarily store large volumes of newspapers, there is used to age-old technique of rolling-up relatively long length sections of the newspaper stream on rolls in a helical configuration and subsequently re-creating the newspaper stream by first unreeling the section from the storage roller to a turning roller, from which the section is then unreeled in the "correct" state, i.e. in the same state as that in which the newspaper stream arrived at the storage roller as described in U.S. Pat. No. 4,637,198 to Gerber.

One problem with this roll-up technique, however, is that it is normally necessary to use tightener belts for winding-up the newspaper stream on the core of the wind-up roll. It is also necessary to adjust the tension in the belts to the number of pages of the individual newspapers, and also with respect to the print, so as to avoid any wrinkling and smudging of the newspapers. Furthermore, the tension in the belts or straps must be reduced, which greatly reduces the newspaper storage capacity of the roll. Furthermore, the roll-up technique is encumbered with the drawback that capacity is dependent on whether or not the newspapers are symmetrical about their longitudinal centre axis in the stream. For instance, if the newspapers have a side fold that lies along one long edge of the stream/section, the roll will be built-up to a greater extent on one side thereof, therewith reducing the storage capacity of the roll.

SUMMARY OF THE INVENTION

Accordingly, one object to the present invention is to provide a method and an apparatus for the temporary storage of newspapers that combine the advantages afforded by the two concepts described above while avoiding at least one of their drawbacks.

This object is achieved with a method of temporarily storing a stream of printed matter in which the stream is divided into generally straight, longitudinal sections, in which the sections are placed side-by-side in a storage space, and in which a stream of printed matter is re-created by joining sections together end-to-end. The method comprises the steps of releasably connecting each section to a respective carrier such as to form a product unit, and releasing the connection between the unit sections and the carrier such as to re-create a newspaper stream.

This object is also achieved with apparatus according to an arrangement for the temporary storage of a stream of printed matter, including means for dividing the stream into generally straight, separate longitudinal sections, and a storage device for storing the sections in side-by-side relationship, and means for re-creating a stream by joining said sections end-to-end, means for releasably connection each section to a carrier to form a product unit in which the printed matter in the section is fixed relative to the carrier, and means for separating the sections from the carrier.

Embodiments of the invention are defined in the steps of connecting the carrier to one long edge of the section, storing the units with the sections hanging down from the carrier, storing the units with the sections upstanding on their respective carrier, orientating the printed matter in said section so that spines of the printed matter will be gripped by the carrier, and disposing the carriers in a storage device that forms the storage space.

Also, the storage device is transportable, the space is provided in a storage device in the form of a transportable cassette, the product units are placed in and removed from a storage device, the carrier includes a strip whose length is greater than the length of the section, such that said strip will have an end-part that projects beyond a respective end of the section, and in that the product unit is suspended with the end-parts resting on corresponding support means in the storage device. The storage space is formed by a storage device that has support legs for establishing the storage space above the surface on which the feet of the support legs rest, and in that the support legs are moved to one side when transporting an empty storage device, so as to reduce the space requirement of the empty cassette. The carrier includes one or more clips, and in that the generally flat newspaper section is moved laterally relative to the carrier such as to insert one long-edge of the section into the clip/clips with the clip/clips being held open, whereafter the clip/clips is/are closed so as to fix the section to the carrier; wherewith the section is released from the carrier by the reverse procedure.

The storage space is provided in a transportable storage cassette, which may contain a plurality of carriers. The carrier includes a strip that has one or more clip fasteners. The cassette has support legs which define a free unit-storage space between the surface against which the legs support and place of connection of the carriers with the cassette, and in that the support legs are movably mounted so as to enable the space required by an empty cassette to be reduced.

The cassettes include transport handling means, and the cassettes have mutually separate bearing surfaces for supporting carrier end-parts that project out beyond respective ends of the section.

A central feature of the invention requires each of the sections of the newspaper stream to be releasably connected to a carrier so as to form a product unit. The newspapers present in said section are therewith fixed to the carrier. The product unit can therefore be orientated freely, without losing the integrity of the section. This enables the units to be handled freely in conjunction with their storage and/or transportation. The carrier may, of course, have many different forms, although a particularly preferred embodiment is one in which the carrier has the form of a long straight strip which includes one or more clips or clamps by means of which said section can be connected to the strip. The carrier is preferably arranged so as to lie along one side edge of said section, with the clip/clips open and facing towards said side-edge, whereafter the strip and the section are displaced in parallel such as to move one long-edge part of said section to a position in the clip/clips, e.g. into contact with an abutment surface in the bottom region of the clips, whereafter the clips are closed. The clips may be of a self-closing type and kept open temporarily with the aid of an opening mechanism in conjunction with fitting the carrier to or removing the carrier from said section.

The section/carrier may have a length of about 2 m, which represents a relatively large number of newspapers.

The carrier may be provided with means, such as eyelets, shoulders, openings or the like, which facilitate gripping and handling and/or fastening of the carrier/the product unit, or which facilitates fastening of the carrier/product unit to and the release of said carrier/product unit from the apparatus that shall carry the product unit or a group of product units. It may be practical to handle the product unit while orientated in a vertical plane and with the longitudinal axis of the carrier/section in the horizontal plane and with said section hanging down from the carrier. When the carrier has a relatively small thickness, the product units can be placed close to one another.

Both ends of the carrier or strip may extend slightly beyond respective ends of the section, such as to allow the carrier to be rested on respective holding surfaces in a storage unit, a cassette. These holding surfaces may, of course, include grooves for receiving the ends of the strips, so as to ensure that a predetermined division is obtained between the units in the storage unit/cassette, said cassette being constructed to allow the newspaper section to hang freely down from said strip. The cassette may have support legs that are sufficiently long for this purpose. These legs may conveniently be retractable or collapsible, so as to reduce the space requirement of the cassettes when transported whilst empty. It will be understood that the cassettes are stackable and that the cassettes can be transported, e.g. when filled with said product units. The cassettes therewith have a very high product capacity. These cassettes, possibly stacked, can thus be transported with conventional transportation equipment, such as fork-lift trucks, containers, etc., to a completely different place, where further processing or treatment of the product units and the newspapers can take place. Upon completion of such further processing, a newspaper stream can be re-created by releasing a newspaper section from said carriers and placing said sections sequentially on a conveyor in a flat state, such as to form a newspaper stream. If desired, the newspaper sections can be joined together to form an essentially continuous stream.

The cassettes may, of course, be circulated through newspaper processing or treatment plants and ultimately arrive back at the place at which a stream of newspapers shall be received for temporary storage and to this end shall be divided into sections which are connected to one such carrier for easier handling, for instance introduced into a cassette for temporary storage and/or transportation and for possible processing or working of the newspapers of the product unit prior to re-creating a stream of such sections.

In the case of further embodiments, the carriers may, of course, be carried by a transporter that can be manoeuvred or driven to enable the newspaper sections to be readily connected to the carriers. For instance, the carriers can be transported by the transporter to the station at which the newspaper sections arrive and there connected to respective sections, such that a product unit will be moved out of the station as the next carrier and the next section arrive at said station.

The transporter may be comprised of a cassette in which a plurality of carriers are mounted in juxtaposed and parallel relationship, and preferably also mounted for pivotal movement about their longitudinal axes.

The product unit may, for example, be arranged to hang in a transporter, for instance a cassette, with respective sections hanging from a respective carrier which, in turn, is carried by the transporter/storage device.

Alternatively, the product units may be arranged to stand upright, with one long edge of a section being fixed to the carrier and said section extending obliquely upwards from the carrier and resting with its lower planar surface against the upper planar surface of a section in a similarly orientated adjacent product unit. When the newspapers in said section are orientated so that the "spines" thereof are gripped by the carrier, certain advantages are afforded, for instance when the newspapers contain or shall be provided with newspaper supplements.

These together with other objects and advantages which will become subsequently apparent reside in the details of and operation as more fully hereinafter described and construction and operation as more fully hereinafter described and claimed, reference being had to the accompanying drawings forming a part hereof, wherein like numerals refer to like parts throughout.

BRIEF DESCRIPTION OF THE DRAWINGS

The invention will now be described with reference to exemplifying embodiments thereof and also with reference to the accompanying drawings.

It will be understood, however, that the invention can be practised in many different forms, of which the embodiment that will now be described is the embodiment preferred at present.

FIG. 4 is a schematic, perspective view of a cassette for the storage and transportation of product units.

FIG. 5 is a schematic illustration of a product unit.

FIG. 6 shows a carrier from above.

FIG. 7 is an end view of the carrier.

DESCRIPTION OF THE INVENTION

Figure 1:
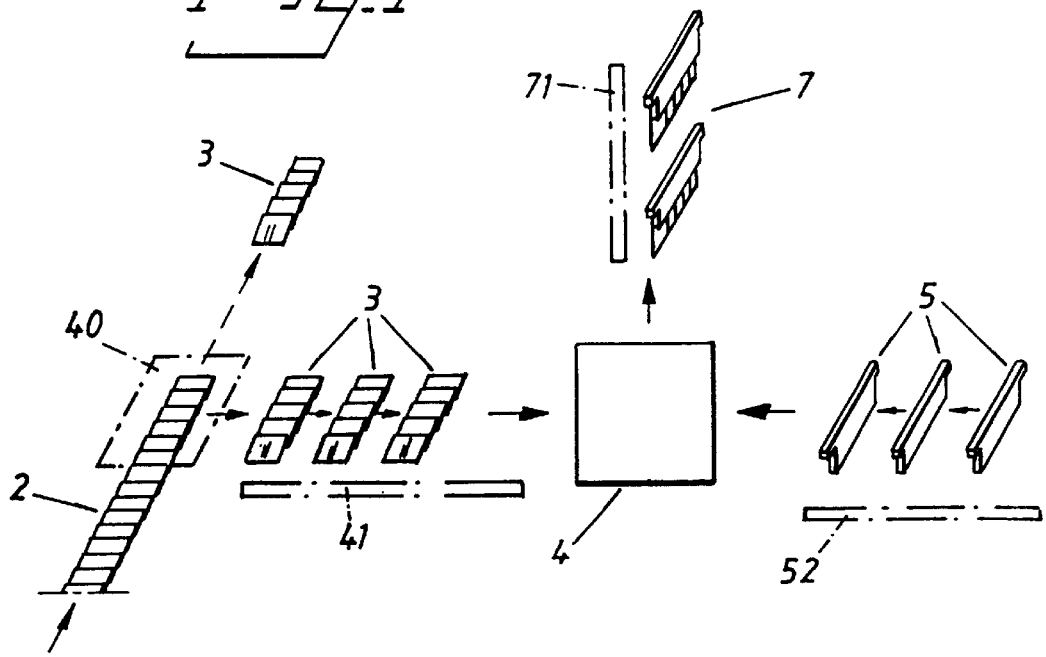
FIG. 1 illustrates schematically the division of a newspaper stream arriving from a press in stream sections, each of which is detachably joined to a carrier to form readily handled product units.

Although only one preferred embodiment of the invention is explained in detail, it is to be understood that other embodiments are possible. Accordingly, it is not intended that the invention is to be limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

FIG. 1 shows a stream 2 of newspapers moving forwards in overlapping relationship from a newspaper press (not shown) in the arrowed direction. The newspaper stream is divided suitably into longitudinal sections, of which each alternate longitudinal section 3 is displaced in a parallel manner from the stream 2 in a direction towards a charging station 4, to which carriers 5 in the form of strips that include one or more clips 6 that are biased towards a closed state (FIGS. 6, 7) is/are also delivered.

A strip 5 is releasably fitted to one long edge of each section 3 arriving in the station 4, such as to form a product unit 7.

These product units 7 can then be readily handled, since the carrier ensures correct mutual positioning and orientation of the newspapers in the section 3. The carrier is rigid at least in its longitudinal direction, so as to enable the correct original spacing between the newspapers in the section to be easily maintained. The carrier will also preferably be flexurally rigid in its plane parallel with said section and generally common therewith, so that the newspapers present in said section will not experience any mutual rotation. The carrier may, of course, be substantially resistant to bending in the plane perpendicular thereto and including the longitudinal axis of the carrier.

The strips will conveniently have a thinness that will enable the sections 3 to be densely packed when the product units 7 are placed closely together adjacent each other, for instance hanging in the vertical plane. The strips can be handled with particular ease, when provided with openings, shoulders, eyelets for handling equipment. They can, however, also be equipped and handled with the aid of gripping equipment that grips directly against the carrier.

Figure 3:
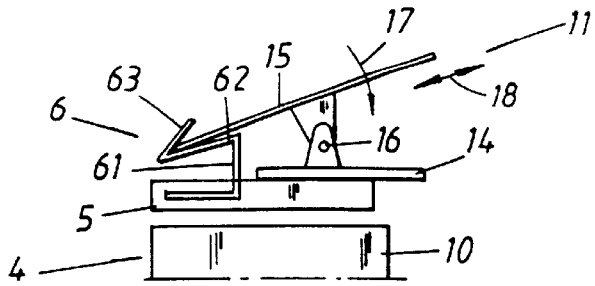
FIG. 3 illustrates schematically a carrier and a carrier-opening mechanism.

FIG. 3 is a schematic illustration of one embodiment of the station 4. The station includes a base 10 which supports the strip 5. The clip 6 is shown to include a web 61 which projects out from the strip 5, and a leg 62 which has a bent free end 63. An opening mechanism 11 is adapted to engage with the end-part 63 of the clip so as to lift said end-part and therewith enable a section to be inserted into or removed from the clip, said clip being spring-biased towards a closed state in the illustrated case. The opening mechanism 11 includes a foot 14 which is pivotally connected at 16 to an arm 15 whose one end is able to engage in the bent end-part 63 of the clip. The foot 14 can support against the upper surface of the strip 5. The mechanism 11 is reciprocatingly movable along 18, so as to enable the arm 15 to be brought into and out of engagement with the end-part 63 of the clip 6. Force applying means are provided for swinging the arm 15 in the direction of the arrow 17 and therewith open the clip 6.

It will be obvious to the person skilled in this art that the station 4 and the mechanism 11 can be given many other designs.

The strip 5 shown in FIG. 6 has a large number of clips 6 which face mutually in the same direction and are spaced essentially equidistantly along one side of the strip 5. The strip 5 also includes a number of openings 21 along one edge part thereof, these openings 21 serving to enable strips 5 to be supported temporarily on rods (not shown) to form a pack of strips that can be subsequently inserted into a storage cassette (FIG. 4).

FIG. 5 illustrates a product unit 7 comprising a carrier 5 which carries a section 3 of a newspaper stream with the aid of its clips 6.

It will be seen from FIG. 5, the strip 5 has end-parts 51 which project beyond respective adjacent ends of the stream section 3. These end-parts 51 of the strip 5 function to enable the units 7 to be readily hung on a cassette according to FIG. 4.

As can be seen from FIG. 4, the cassette 30 includes a frame 31 which may include parallel tunnels 32 adapted to receive the forks of a fork-lift truck or the like. Arranged beneath the frame 31 of the cassette are two mutually separate and mutually parallel bearing rails 33 which are provided along their respective lengths with guide means 34 for co-action with the end-parts 51 of the strips 5. The guide means have the form of parallel grooves which are mutually spaced at a distance which provides optimum packing density of transport units 7 in the cassette. The strips 5 are turned so as to be generally flexurally rigid in their plane when said plane is orientated vertically and the stream 3 hangs vertically down from the strip 5 as supported by the cassette 30.

The outer dimensions, length and width of the cassette, may be chosen as standard for transport units to the greatest possible extent. For instance, the size of the cassette 30 may be roughly a multiple of the size of a standard pallet.

As illustrated in FIG. 4, the cassette 30 may be provided with support legs 36 which can be moved between a vertically extended position (shown in FIG. 4) to an inwardly folded position in which the thickness of the cassette 30 is minimised.

When the support legs 36 are swung down and rest on a supportive surface, the units 7 suspended in the cassette 30 are able to hang freely without touching said surface. The supportive surface may be the upper side of a cassette 30. The retractable legs 36 enable the cassettes to be returned in an empty state, or while carrying only the strips 5, with minimised space requirements.

The skilled person will realise that the units 7, i.e. the newspapers in respective sections 3 included in each unit 7, can be processed or worked before joining the sections together to form a newspaper stream, after loosening said units 7.

Figure 2:
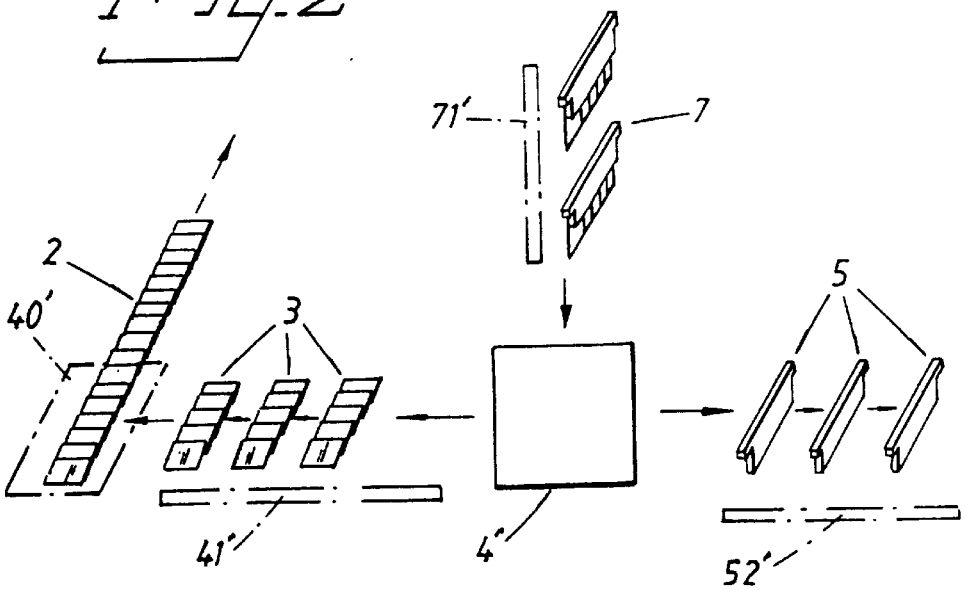
FIG. 2 illustrates schematically the disbandment of product units, by removing the carrier form each product unit and joining the stream sections freed from the carriers end-to-end to form a stream.

As will be seen from FIG. 2, a series of units 7 can be moved into the station 4 in which the strips are removed from the newspaper sections, such that a series of strips 5 and a series of sections 3 will leave the station 4. The sections 3 can then be joined together by means of an overlapping end-join, such as to form a continuous stream of newspapers 2, for instance such as to re-create the stream 2 shown in FIG. 1.

It will thus be evident that the sections carried by the units 7 can be separated from the strips 5 and joined to form newspaper streams for said processing or working operation, possibly several batches that are separated by re-joining the sections to straight-edges to form units 7 that, in turn, can be stored and transported respectively with said cassettes. This enables the newspapers to be processed or worked in flows that are adapted to the capacity of the various processing occasions and in places that may be located far from the location of the printing press.

FIGS. 1 and 2 illustrate schematically an arrangement 40 for dividing the stream 2 into sections 3, and an arrangement 41 for transporting the sections 3 to the station 4. Also shown schematically is an arrangement for transporting the unit 7 from the station 4, and an arrangement 52 for transporting the carriers 5 to the station 4. Corresponding arrangements have been identified in FIG. 2 with the same reference numeral to which a prime has been added.

FIGS. 1 and 2 illustrate schematically an arrangement 40, 40' for dividing the stream 2 into sections 3, and an arrangement 41, 41' for transporting the sections 3 to the station 4, 4'. Also shown schematically is an arrangement 71, 71' for transporting the product unit 7 from the station 4, 4', and an arrangement 52, 52' for transporting the carriers 5 to the station 4, 4'. As noted in the figures, corresponding arrangements have been identified in FIG. 2 with the same reference numeral to which a prime has been added.

FIG. 1 indicates that the newspaper stream 2 is divided into two sub-streams of sections 3 which are each delivered to a respective station 4. This division is beneficial in several respects. When the temporarily stored units 7 are to be reunited to form a stream 2, this can be achieved conveniently in one single station, as illustrated in FIG. 2.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

FIGS. 1 and 2 illustrate schematically an arrangement 40, 40' for dividing the stream 2 into sections 3, and an arrangement 41, 41' for transporting the sections 3 to the station 4, 4'. Also shown schematically is an arrangement 71, 71' for transporting the product unit 7 from the station 4, 4', and an arrangement 52, 52' for transporting the carriers 5 to the station 4, 4'. As noted in the figures, corresponding arrangements have been identified in FIG. 2 with the same reference numeral to which a prime has been added.

FIG. 1 indicates that the newspaper stream 2 is divided into two sub-streams of sections 3 which are each delivered to a respective station 4. This division is beneficial in several respects. When the temporarily stored units 7 are to be reunited to form a stream 2, this can be achieved conveniently in one single station, as illustrated in FIG. 2.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A method of temporarily storing a stream of printed matter in which said stream is divided into generally straight, longitudinal sections, in which said sections are placed side-by-side in a storage space, and in which said stream of printed matter is re-created by joining sections together end-to-end, the method comprising the steps of releasably connecting each section to a respective carrier to form a product unit with sections, and releasing a connection between said product unit with said sections and said carrier such as to re-create said stream of printed matter, said at least one carrier including at least one clip, and said generally straight, longitudinal sections being flat and moving laterally relative to said at least one carrier such as to insert one long-edge of said section into said at least one clip with said at least one clip being held open, whereafter closing said at least one clip to fix said section to said at least one carrier, and said section being released from said at least one carrier by a reverse procedure.

2. The method according to claim 1, further comprising the step of connecting said carrier to one long edge of said section.

3. The method according to claim 1, further comprising he step of storing said product units with said section parallel on their respective carrier.

4. The method according to claim 1, further comprising the step of orientating said printed matter in said section so that spines of said printed matter will be gripped by said carrier.

5. The method according to claim 1, further comprising the step of disposing said carriers in a storage device that forms said storage space.

6. The method according to claim 5, wherein said storage device is transportable.

7. The method according to claim 1, wherein said storage space is provided in a storage device in a form of a transportable cassette.

8. The method according to claim 1, wherein said product units are placed in and removed from a storage device.

9. The method according to claim 1, wherein said carrier includes a strip whose length is greater than a length of said section, such that said strip will have an end-part that projects beyond a respective end of said section; and in that said product unit is suspended with said end-parts resting on corresponding support means in said storage device.

10. The method according to claim 1, wherein said storage space is formed by a storage device that has support legs for establishing said storage space above said surface on which feet of said support legs rest;

and in that said support legs are moved to one side when transporting an empty storage device, so as to reduce said space requirement of said empty cassette.

11. An arrangement for a temporary storage of a stream of printed matter, including means for dividing said stream into generally straight, separate longitudinal sections, a storage device for storing said sections in side-by-side relationship, and means for re-creating a stream by joining said sections end-to-end, said arrangement comprising means for releasably connecting each section to at least one carrier to form a product unit in which said printed matter in said section is fixed relative to said at least one carrier and means for separating said sections from said at least one carrier, said at least one carrier including at least one clip, and said generally straight sections being flat and moving laterally relative to said at least one carrier such as to insert one long-edge of said section into said at least one clip with said at least one clip being held open, whereafter closing said at least one clip to fix said section to said at least one carrier, and said section being released from said at least one carrier by a reverse procedure.

12. The arrangement according to claim 11, wherein said storage space is provided in a transportable storage cassette, which contains said at least one carrier.

13. The arrangement according to claim 11, wherein said at least one carrier includes a strip having at least one clip fastener.

14. The arrangement according to claim 12, wherein said cassette has support legs which define a free unit-storage space between said surface against which said legs support and place of connection of said carriers with the cassette; and in that the support legs are movably mounted so as to enable said space required by an empty cassette to be reduced.

15. The arrangement according to claim 12, wherein said cassettes include transport handling means.

16. The arrangement according to claim 12, wherein said cassette have mutually separate bearing surfaces for supporting carrier end-parts that project out beyond respective ends of said section.

* * * * *